US005838094A

United States Patent [19]

Hanspal

[11] Patent Number: 5,838,094

[45] Date of Patent: Nov. 17, 1998

[54] SEALS AND IGNITERS

[75] Inventor: Jagdevinder Singh Hanspal, Stoke Poges, England

[73] Assignee: Smiths Industries PLC, London, England

[21] Appl. No.: 728,976

[22] Filed: Oct. 11, 1996

[30] Foreign Application Priority Data

Oct. 21, 1995 [GB] United Kingdom ..... 9521605

[51] Int. Cl.[6] ..... H01T 13/02

[52] U.S. Cl. ..... 313/141; 313/11.5

[58] Field of Search ..... 313/141, 135, 313/137, 143, 145, 11.5, 47

[56] References Cited

U.S. PATENT DOCUMENTS 3,745,400 7/1973 Meyer ..... 313/141

FOREIGN PATENT DOCUMENTS 294880 7/1928 United Kingdom .
475878 11/1937 United Kingdom .
507846 6/1939 United Kingdom .
809915 3/1959 United Kingdom .
815655 7/1959 United Kingdom .
1084815 9/1967 United Kingdom .
1164638 9/1969 United Kingdom .
1393913 5/1975 United Kingdom .

*Primary Examiner*—Richard Chilcot
*Assistant Examiner*—Harshad Patel
*Attorney, Agent, or Firm*—Pollock, Vande Sande & Priddy

[57] ABSTRACT

An igniter has an inner electrode extending with a forward and rear ceramic sleeve. The rear end of the forward sleeve projects as a sliding fit within the forward end of the rear sleeve. A nickel alloy flange with a flexible shoulder has an inner neck brazed to a nickel layer on the outside of the rear sleeve. An outer collar on the flange is welded to the inside of the outer electrode to form a seal between the outside of the sleeve and the inside of the outer electrode. A metal cap is brazed to a nickel layer at the rear end of the rear sleeve and is welded to the inner electrode to seal the rear end of the rear sleeve.

8 Claims, 1 Drawing Sheet

SEALS AND IGNITERS

BACKGROUND OF THE INVENTION

This invention relates to seals and to igniters having a seal.

Igniters used in engines extend through a wall of the engine and have their forward, operative tip located in the region of the engine's combustion chamber. Because of this, the igniter must provide an effective seal against the escape of gases through the igniter at the high temperatures met in the engine. Igniters usually include an outer metal body and an inner metal electrode extending within the body and insulated from it by a sleeve of insulative material, such as a ceramic. One of the difficulties of providing an effective seal in igniters arises from the need to form a seal between the insulator and the metal components, which have very different properties. A further complication arises because of the different coefficients of thermal expansion of the insulator and metal components, which can result in relative movement between the components on changes in temperature. It has been proposed in U.S. Pat. No. 3,745,400 to braze a metal seal between a central metal electrode and an outer insulator towards its cooler, rear end. Such a seal, however, may not be sufficiently effective if subjected to prolonged elevated temperatures and pressures.

BRIEF SUMMARY OF THE INVENTION

It is an object of the present invention to provide a seal and an igniter including a seal that can be used to withstand pressure and temperature.

According to one aspect of the present invention there is provided a seal between an inner component and a concentric outer component, one component being of a metal and the other being of a non-metallic material, the seal comprising a metallized layer on a surface of the non-metallic component, a metal flange member comprising an inner neck portion of circular shape embracing the outer surface of the inner component, an outer collar portion in contact with the inner surface of the outer component and a flexible shoulder portion extending between the neck portion and the collar portion, the flange member being welded or brazed to the metal component and to the metallized layer on the non-metallic component.

The shoulder of the flange member may be S-shape in section. The flange member is preferably of a nickel alloy and the metallized layer may be of nickel.

According to another aspect of the present invention, there is provided an igniter including a seal according to the above one aspect of the invention.

According to a further aspect of the invention there is provided an igniter including an outer tubular electrode, an inner electrode extending concentrically within the outer electrode, a sleeve of a non-metallic material extending along the inner electrode, a metal flange member having an inner neck portion of circular shape embracing the outer surface of the sleeve, an outer collar portion in contact with the inner surface of the outer electrode, and a flexible shoulder portion extending between the neck portion and the collar portion, a part at least of the outside of said sleeve having a metallized layer, and the flange member being welded or brazed to said metallized layer and to the outer electrode.

The sleeve assembly is preferably of a ceramic material and may include two electrically-insulative sleeves surrounding the inner electrode, a first sleeve extending along the forward part of the inner electrode, a second sleeve being a sliding fit with the rear of the first sleeve, and the metallized layer being provided on the second sleeve. The igniter preferably has a second seal at the rear end of the sleeve assembly comprising a second metallized layer on the sleeve assembly and a metal cap brazed to the second metallized layer. The metal cap is preferably welded to the inner electrode. The or each metallized layer may be of nickel and the flange member of a nickel alloy. The outer electrode may comprise a forward part and a rear part joined to the rear end of the forward part, the forward end of the rear part abutting the shoulder of the flange member.

An igniter according to the present invention will now be described, by way of example, with reference to the accompanying drawing.

DETAILED DESCRIPTION OF THE PREFERRED EMBODIMENT

Figure 1:
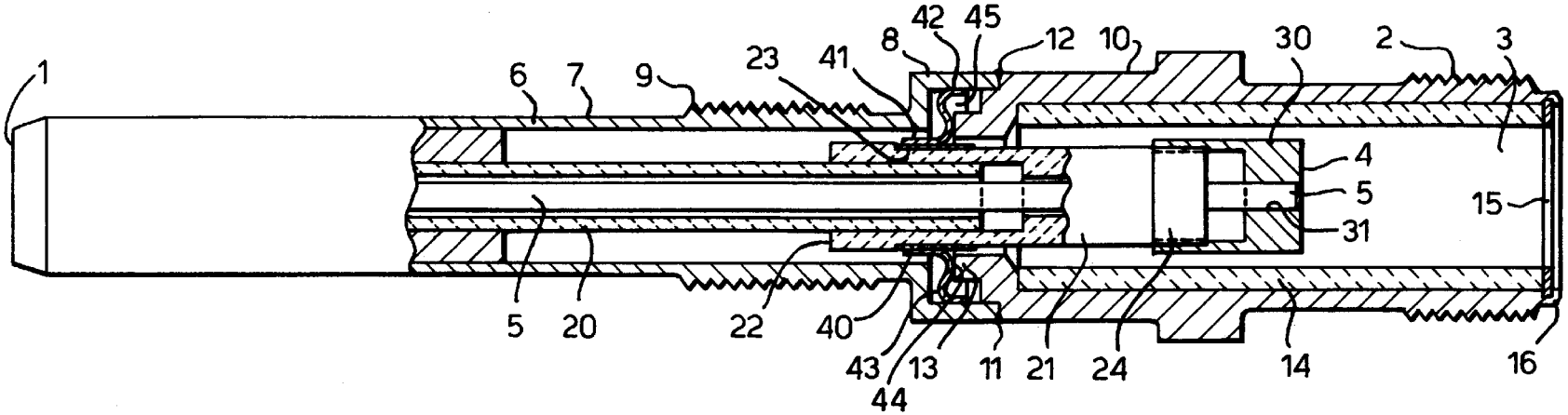
FIG. 1 is a sectional side elevation of the igniter.
Figure 1A:
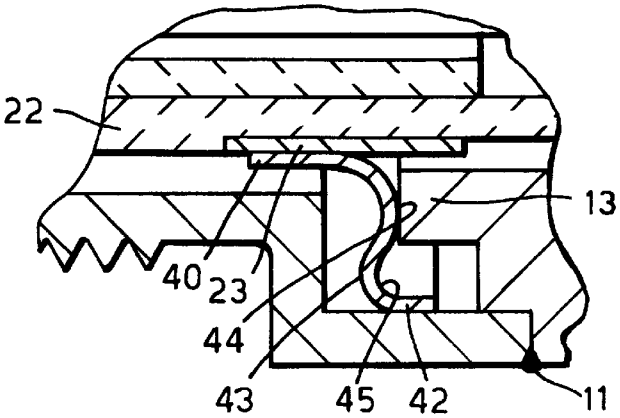
FIG. 1A is an enlarged view of a portion of the structure shown in FIG. 1.

The igniter is about 12 cm long and of cylindrical shape with a circular section having a diameter of about 12 mm at its tip or forward, left-hand end 1. The tip 1 of the igniter provides the operative end at which discharge occurs. The right-hand end 2 of the igniter has a recess 3 in which is located a terminal 4 by which electrical connection is made to the igniter's central electrode 5. The central electrode 5 extends to the tip 1, so that a spark gap (not shown) is formed at the operative tip between the central electrode and the outer body 6 of the igniter.

The outer body 6 is in two parts. The forward part 7 is about 73 mm long and is made of an electrically-conductive, heat-resistant metal such as a stainless steel. At its rear end, the forward part 7 is enlarged to a diameter of about 19 mm, thereby forming an external and internal step 8. Just forwardly of this step 8, the forward part 7 has an external screw thread 9, which is used to secure the igniter into a threaded aperture in the wall of an engine (not shown).

The outer body 6 of the igniter is completed by a rear, head part 10 joined at its forward end to the rear end of the forward part 7 by a peripheral electron beam weld 11, where the two parts contact one another. The head part 10 is also of a metal, such as a stainless steel, which need not be as heat-resistant as the forward part, because it is outside the combustion chamber. At its forward end, the head part 10 is formed with an outer step 12, in which sits the rear end of the forward part 7. The forward end of the head 10 also has an inner step 13, which extends into the enlarged step 8 at the rear end of the forward part 7.

An electrically-insulative sleeve 14, such as of alumina ceramic, is located within the head part 10 and is retained by a metal washer 15 held between the right-hand end of the sleeve and a part 16 of the right-hand end of the head, which is rolled inwardly over the washer.

The central electrode 5 extends within a sleeve assembly formed by two electrically-insulative alumina sleeves 20 and 21. One sleeve 20 extends forwardly, from a location approximately level with the weld 11, between the forward and head parts 7 and 10 of the outer body 6. This forward sleeve 20 is of circular shape and a loose fit around the central electrode 5. The rear sleeve 21 embraces the rear end of the forward sleeve 20 by a distance of about 1 cm and extends rearwardly to within about 8 mm of the rear end of the central electrode 5. The rear sleeve 21 is a close sliding fit on the forward sleeve 20. At its forward end, the rear sleeve 21 has a shallow external flange 22 projecting around the periphery of the sleeve. Immediately to the rear of this, the sleeve has an external metallized band 23 of nickel plate, which is about 0.03 mm thick and is formed using nickel sulphamate solution to Def. Stan. 03-27. The band 23 extends rearwardly beyond the forward end of the step 12. A similar nickel metallized band 24 is formed around the outside of the sleeve 21 at its rear end. Internally, the bore through the rear sleeve 21 is reduced in diameter a short distance rearwardly of the end of the forward sleeve 20 so that it is a loose fit about the central electrode 5.

A terminal cap 30 of a nickel iron alloy is joined to both the rear end of the central electrode 5 and the rear end of the rear ceramic sleeve 21 to form the inner terminal 4. The cap 30 has a flat rear end, closed except for a central aperture 31. The rear end of the central electrode 5 projects into the central aperture 31 and is sealed in it by an argonarc weld. The forward end of the cap 30 is open and embraces the rear end of the sleeve 21, the cap being attached to the sleeve by brazing its inner surface to the metallized band 24. This gives a secure, gas-tight seal between the rear end of the sleeve 21 and the central electrode 5.

The rear sleeve 21 is also sealed, towards its forward end, to the outer electrode or body 6. This is achieved by a flange 40 of 29/17 nickel cobalt iron alloy. The flange 40 has an inner neck 41 of cylindrical shape and circular section joined with an outer collar 42 by a flexible shoulder 43 of S-shape in section extending from the rear end of the neck 41 to the forward end of the collar 42. When viewed from the right, the shoulder 43 presents an inner, annular convex region 44 and an outer, annular concave region 45. The rear side of the inner convex region 44 is abutted by the forward end of the inner step 13 of the head 10. The inner surface of the neck 41 is brazed to the metallized band 23 on the sleeve 21, whereas the collar 42 is electron beam welded about its right-hand end to the inside of the forward part 7 of the outer body 6. The neck 41 can be brazed to the sleeve 21 before assembly on the central electrode 5. The collar 42 is welded to the body 6 before assembly of the head 10 on the forward part 7.

The flange 40 provides a gas-tight seal between the ceramic sleeve 21 and the metal outer body 6. An effective seal between the flange 40 and the ceramic is provided by virtue of the metallized layer 23. Since the terminal cap 30 seals the central electrode 5 to the sleeve 21, it can be seen that a gas-tight seal is provided between the central electrode 5 and the outer electrode 6. There is no gas seal between the two ceramic sleeves 20 and 21. Because, however, the external junction between the two sleeves 20 and 21 is located forwardly of the flange 40, gas can only escape into the space outside the sleeves at a location forwardly of the flange and is, therefore, prevented from escaping from the rear of the igniter.

The shoulder 43 of the flange 40 can flex so that the inner part of the sleeve 21 can move axially relative to the outer body 6 without compromising the seal. This enables relative thermal expansion between the outer body 6, the ceramic sleeves 20 and 21, and the central electrode 5.

What I claim is:

1. A seal between an inner metal component and a concentric outer tubular metal component, wherein the seal comprises: a tubular sleeve of electrically-insulative material extending coaxially between said inner and outer components, a rigid seal between an outer surface of said tubular sleeve and said inner component, a metallized layer on the outer surface of the tubular sleeve; and a metal flange member, said flange member including an inner neck portion of circular shape embracing the outer surface of said tubular sleeve, an outer collar portion in contact with an inner surface of said outer component and a flexible shoulder portion extending between said neck portion and said collar portion, and wherein said flange member is joined with the inner surface of said outer component and with said metallized layer on said tubular sleeve.

2. A seal according to claim 1, wherein said flexible shoulder portion of said flange member is S-shape in section.

3. A seal according to claim 1, wherein said flange member is of a nickel alloy.

4. A seal according to claim 1, wherein said metallized layer is of nickel.

5. An igniter comprising: an inner metal electrode; an outer tubular metal electrode, said outer electrode being concentric with said inner electrode, a first tubular sleeve of electrically-insulative material extending coaxially between said inner and outer electrodes, a rigid seal between an outer surface of said tubular sleeve and said inner electrode, a metallized layer on the outer surface of said tubular sleeve, a metal flange member comprising an inner neck portion of circular shape embracing an outer surface of said tubular sleeve, an outer collar portion in contact with an inner surface of said outer electrode and a flexible shoulder portion extending between said neck portion and said collar portion, and wherein said flange member is joined with the inner surface of said outer electrode and with said metallized layer on said tubular sleeve.

6. An igniter according to claim 5, wherein said tubular sleeve is of a ceramic material.

7. An igniter according to claim 5 including a second electrically-insulative tubular sleeve surrounding said inner electrode, wherein said first sleeve extends along a rear part of said inner electrode, and wherein said second sleeve is a sliding fit with a forward end of said first sleeve.

8. An igniter according claim 5, wherein said outer electrode comprises a forward part and a rear part, wherein said rear part is joined to a rear end of said forward part, and wherein a forward end of said rear part abuts said shoulder portion of said flange member.

* * * * *